United States Patent [19]

Goffinet et al.

[11] 4,139,479

[45] Feb. 13, 1979

[54] TEXTILE TREATING COMPOSITION

[75] Inventors: Pierre C. E. Goffinet; Jean-Pierre C. I. M. Leclercq, both of Brussels, Belgium

[73] Assignee: The Procter & Gamble Company, Cincinnati, Ohio

[21] Appl. No.: 801,686

[22] Filed: May 31, 1977

[30] Foreign Application Priority Data

Jun. 4, 1976 [GB] United Kingdom ..... 23176/76
Oct. 29, 1976 [GB] United Kingdom ..... 45079/76

[51] Int. Cl.[2] ..... D06M 13/46
[52] U.S. Cl. ..... 252/8.8; 8/115.6; 252/8.75; 252/8.6
[58] Field of Search ..... 252/8.8, 8.75, 8.6; 8/115.6

[56] References Cited

U.S. PATENT DOCUMENTS

| | | | |
|---|---|---|---|
| 3,920,563 | 11/1975 | Wixon | 252/8.8 |
| 3,958,059 | 5/1976 | Diehl | 252/8.8 |
| 3,959,155 | 5/1976 | Montgomery et al. | 252/8.8 |

FOREIGN PATENT DOCUMENTS 1329416 9/1973 United Kingdom.

*Primary Examiner*—William E. Schulz

[57] ABSTRACT

A textile-treating composition comprises a fabric-substantive cationic surfactant and a water-insoluble salt of a carboxylic acid having from 16 to 24 carbon atoms. Particularly useful water-insoluble salts are the calcium, aluminium or magnesium salts of stearic acid. Fabrics treated with the composition, either directly or in dilute aqueous solution, have enhanced softness and antistatic properties.

9 Claims, No Drawings

TEXTILE TREATING COMPOSITION

BACKGROUND OF THE INVENTION

The invention relates to textile treatment compositions and, especially, textile softening compositions comprising cationic surfactants and certain highly insoluble carboxylates.

It has long been recognised that certain chemical compounds have the capability of imparting softness to textile fabrics. These compounds, which are known generally as "softening agents", "fabric softeners", or "softeners", have been used both by the textile industry and by housewives in the laundry to soften a finished fabric, thereby making the fabric smooth, pliable and fluffy to handle. In addition to the quality of softness, the fabrics frequently have a reduced tendency to static cling and are easier to iron.

The softening agents which are usually employed in compositions intended for use by the housewife are cationic surfactant compounds, commonly quaternary ammonium compounds having at least two long alkyl chains, for example distearyl dimethyl ammonium chloride. The positive charge on the softening compound encourages its deposition onto the fabric substrate, the surface of which is usually negatively charged.

However, although the above mentioned cationic compounds are highly effective softeners when applied in a rinse solution, there are certain disadvantages associated with their use. For example, the cationic compounds having long alkyl chains are very sensitive to carry over of anionic detergent which tends to neutralize the softening effect because the anionic-cationic complex tends to precipitate out of solution. Also, certain cationic surfactant compounds are expensive and in short supply and it is therefore desirable for commercial reasons, to provide softening compositions having a reduced amount of cationic surfactant compound. Furthermore, softening compositions which comprise predominantly long chain cationic compounds have the disadvantage that the treated fabrics tend to become overloaded with softener and become discolored, greasy or undesirably non-absorbent.

It is known that highly insoluble carboxylates, specifically the heavy metal soaps typified by calcium stearate, have textile softening properties. For instance, British Pat. No. 1,329,416 describes detergent compositions having textile softening effect comprising anionic, nonionic, zwitterionic or amphoteric surfactants and finely dispersed insoluble soaps. Cationic surfactants are generally deemed to be poor detergents, in that they do not remove dirt very well. Thus it is understandable that the inventors of BP 1,329,416 did not include them among suitable detergent actives for their detergent compositions. What they evidently failed to observe, and do not disclose, is that cationic surfactants enhance the deposition and hence the effectiveness of these insoluble soaps upon fabrics.

SUMMARY OF THE INVENTION

The present invention provides a textile-treating composition comprising (a) a fabric-substantive cationic surfactant, and (b) a substantially water-insoluble salt of a carboxylic acid having from 16 to 24 carbon atoms.

The compositions are preferably intended to be formulated as aqueous dispersions for use as rinse additives, i.e., to be added to the final rinse liquor after a laundering operation. However, the may be formulated so as to be suitable for spraying on to fabrics as from an aerosol container, or they may be in paste or granular form or encapsulated and in the form of a dispersion of microcapsules, or they may be releasably associated with a rigid or flexible insoluble substrate.

DETAILED DESCRIPTION OF THE INVENTION

The Cationic Surfactant

Any fabric susbstantive cationic material can be utilised in the present invention, but preferred surfactants are from the group consisting of (i) non-cyclic quaternary ammonium salts having two $C_{12-30}$ alkyl chains, (ii) substituted amine salts of the formula

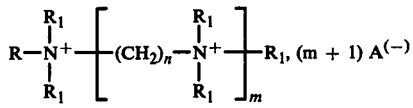

(I)

wherein R is a substituted or unsubstituted alkyl or alkenyl group having 10 to 22 carbon atoms; each $R_1$ is independently selected from hydrogen, $(C_2H_4O)_pH$ or $(C_3H_6O)_pH$, where p is from 1 to 3, and $C_{1-3}$ alkyl; m is from 0 to 6; n is from 2 to 6; and $A^{(-)}$ represents an anion, (iii) $C_{8-25}$ alkyl imidazolinium salts, (iv) $C_{12-20}$ alkyl pyridinium salts, and (v) a mixture of any two or more of these.

The general term "substituted alkyl" is intended to include alkyl groups interrupted by functional groups such as —O—, —S—, —$C_6H_4$—, etc.

The preferred cationic surfactants of class (i) useful in the present invention are quaternary ammonium salts of the general formula $$R_2R_3R_4R_5N^+A^-$$

wherein groups $R_2$ and $R_3$ are each $C_{16}$–$C_{20}$ alkyl and groups $R_4$ and $R_5$ are each $C_1$–$C_4$ alkyl or hydroxyalkyl, and A is an anion, for example chloride, bromide, methyl sulfate, etc.

Alkyl imidazolinium salts of class (iii) useful in the present invention are generally believed to have cations of the general formula

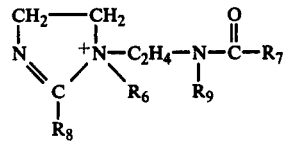

or

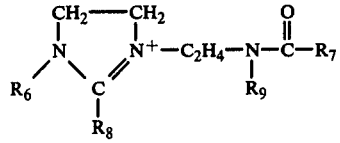

wherein $R_6$ is a $C_1$–$C_4$ alkyl radical, $R_7$ is $C_9$–$C_{25}$ alkyl, $R_8$ is hydrogen or a $C_8$–$C_{25}$ alkyl radical and $R_9$ is hydrogen or a $C_1$–$C_4$ alkyl radical.

A preferred member of this class is believed to have $R_6$ methyl and $R_7$ and $R_8$ tallow alkyl, $R_9$ hydrogen, and is commercially available under the trade name VARI- SOFT 455, marketed by Ashland Chemical Company, Ohio, U.S.A.

Alkyl pyridinium salts of class (iv) useful in the present invention have cations of the general formula

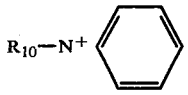

wherein $R_{10}$ is a $C_{12}$–$C_{20}$, preferably $C_{16}$ or $C_{18}$ alkyl radical.

It will be understood that the main function of the cationic surfactant is to encourage deposition of softener and it is not, therefore, essential that the cationic surfactant itself have substantial softening properties, although this may be the case. Indeed, it is preferred that at least a part of the cationic component of the composition comprises a surfactant having only a single alkyl chain, as such compounds have greater solubility in water and can more effectively provide the appropriate positive charge distribution and the degree of hydration on the surface of the emulsified nonionic softener particle.

Thus, compounds of class (ii) are preferred especially those having a single $C_{12}$–$C_{22}$, preferably $C_{14}$–$C_{18}$, alkyl group.

One group of preferred cationic surfactants of class (ii) are the quaternary ammonium salts of the formula $$R_1 R_2 R_3 R_4 N^+ A^-$$

wherein group $R_1$ is $C_{12}$–$C_{22}$, preferably $C_{16}$–$C_{18}$ fatty alkyl and groups $R_2$, $R_3$ and $R_4$ are each $C_1$–$C_4$ alkyl, preferably methyl.

Another group of useful surfactants of class (ii) are the mono-amine salts of the formula $R_1 R_2 R_3 N^+ H A^-$ where $R_1$ is $C_{12}$–$C_{22}$, preferably $C_{16}$–$C_{18}$ alkyl and $R_2$ and $R_3$ are each selected independently from hydrogen and $C_1$–$C_4$ alkyl, especially methyl.

Also useful in the present invention are substituted polyamine salts of the general formula

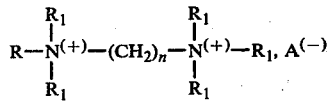

(I)

wherein R, $R_1$, A and n are as hereinbefore defined.

The polyamine salts of this type provide additional positive charge to the particle and thereby improve deposition of the heavy metal soaps.

The mono substituted derivatives of 1,3-diaminopropanol are very effective, that is compounds of the formula

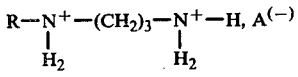

wherein R is as described above, and preferably is predominantly $C_{16}$–$C_{18}$ alkyl, derived from tallow fatty acids. $A^-$ may represent a dihalide or any appropriate acidic radical such as the diacetate, or higher saturated or unsaturated acyl groups up to $C_{22}$. A preferred compound of this class is believed to have the formula

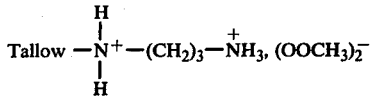

and is sold under the trade names Dinoramac (Messrs. Pierrefitte-Auby) or Duomac (Messrs. Armour-Hess), or more preferably the corresponding halide, especially chloride. "Tallowyl" represents the predominantly $C_{16}$ to $C_{18}$ alkyl groups derived from tallow fatty acids.

The unprotonated amine may also be used to prepare the compositions but it is highly preferred for a good product performance that their pH be such that at least one of the amine groups of the polyamine is present in them, or at least in the treatment bath, in protonated form.

Also suitable are the corresponding diquaternary ammonium salts such as N-tallow-N,N,N', N', N' pentamethyl-1,3 propylene diammonium dichloride, which is commercially available under the trade names STABIRAN MS-3 (Pierrefitte-Auby), DUOMAC (Armour-Hess); and ADOGEN 477 (Ashland Co.), and N-tallow-N,N',N'-triethanol-1,3-propylenediamine hydrochloride.

Highly preferred diamines are compounds carrying ethoxylate groups on the nitrogen atoms, for example those having the general formula

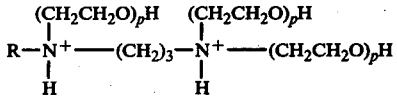

Especially useful members of this class have p = 1 and a $C_{16}$–$C_{22}$ alkyl chain.

The Carboxylic Acid Salt

The water insoluble carboxylates should preferably be highly insoluble, that is they should have water solubility less than 20 g. per liter at 25° C., preferably less than 1 g. per liter. Preferred carboxylates are the heavy metal salts of fatty acids (whether derived from natural fats or synthetically, and whether saturated or unsaturated) having about 16 to 24 carbon atoms. Suitable acids include palmitic, oleic, linoleic, stearic, arachidic, behenic, and the like. Suitable metals include calcium, magnesium, aluminium, zinc, barium and others, with preference for those whose carboxylates are uncoloured. The mono, di, and where applicable, tri-carboxylates may be employed. Preferred are calcium distearate and aluminium distearate.

The proportions of cationic surfactant and insoluble carboxylate in the compositions can vary quite widely. Thus, the relative proportions of cationic and carboxylate can be from about 50:1 to about 1:10, preferably from about 10:1 to 2:3, and especially from about 3:2 to 2:3. The actual concentration of these components in the compositions of the invention depends upon the extent to which they are designed to be diluted in a treatment bath or solution. Rinse additive compositions used at low concentrations have become widely employed in recent years and the amount to be used has become conventional. If the present compositions are intended to be used in the rinse in these now conventional amounts, a concentration about 0.1 to 15% cationic surfactant, preferably from about 2 to 10% by weight is appropriate, and from about 0.1 to 10%, preferably about 1 to 6% of insoluble carboxylate. Of course, smaller amounts of more concentrated dispersions could be used. In the actual treatment bath, a concentration of about 10 to 25 parts per million to 0.1%, preferably about 50 to 500 ppm by weight of heavy metal carboxylate and cationic together may be employed. Higher concentrations might be used in compositions intended to be sprayed neat onto fabrics.

Optional Ingredients

In addition to the cationic surfactant and soluble carboxylate, the compositions may contain small amounts of nonionic surfactants as emulsifiers. In particular, however, they may contain nonionic components, not necessarily surfactants, having beneficial effects upon the fabrics to be treated or in the ironing operation. Preferred nonionic fabric conditioning substances are textile softeners represented by fatty acid esters and partial esters of mono- or polyhydric alcohols having from 1 to 8 carbon atoms. It is preferred that the fatty acid ester should have at least 1 free, i.e., unesterified, hydroxyl group and at least one fatty acyl group. Such additives include nonionic textile softening agents such as sorbitan esters, as described in German Offenlegungsschrift 2,516,104, glyceryde esters of $C_{12}$–$C_{22}$ fatty acids, e.g., glycerylmonostearate, and fatty alkyl esters of $C_2$–$C_6$ polyols, and zwitterionic surfactants or amine or phosphine oxides as described in U.S. Pat. No. 3,686,025. Other substances which may be added are pyrodextrins and modified dextrins.

In rinse-added compositions, a content of about 1 to about 10% by weight, preferably about 1.5 to about 6% of said agents is usually suitable.

In addition to the above described components, the compositions may contain other textile treatment or conditioning agents. Such agents include silicones. Some suitable silicones are predominantly linear polymers, that is they are poly dialkyl- or diaryl-siloxanes. The alkyl groups have 1 to 5 carbon atoms, and are preferably methyl. The alkyl groups may be wholly or partially fluorinated. A limited degree of cross linking can be tolerated, and up to about 10% by weight of mono-alkyl siloxanes may be present in the silicones.

Preferred silicones are polydimethyl siloxanes having viscosity at 25° C. in the range 100 to 200000 centistockes, preferably 1000 to 120000. Other preferred silicones are fluorinated silicones having viscosity at 25° C. of at least 100 centistokes, as described in German Offenlegungsschrift No. 2,631,419. Preferred are silicones of cationic character. These silicones are either:

(a) A predominantly linear di $C_1$–$C_5$ alkyl or $C_1$–$C_5$ alkyl, aryl siloxane having a viscosity at 25° C. of at least 100 centistokes, prepared using a cationic surfactant as emulsifier.

(b) An $\alpha,\omega$-di quarternized di $C_1$–$C_5$ alkyl or $C_1$–$C_5$ alkyl aryl silicone polymer, or (c) An amino-functional di $C_1$–$C_5$ alkyl or alkyl aryl siloxane polymer in which the amino group may be substituted and may be quaternized and in which the degree of substitution (d.s.) lies in the range 0.001 to 0.1, preferably 0.01 to 0.07.

The silicone component is preferably used in an amount of from about 0.5% to about 10%, most preferably from 1% to 6% of the softener composition. When these additional components are included the ratio of cationic surfactant to total of insoluble soap and additional component is usually in the range from about 10:1 to 1:10.

Other components appropriate to the type of compositions being formulated may also be present. Such components are preservatives, bactericides, whether effective to protect the composition or to treat fabrics, viscosity controllers, coloring and perfuming materials and the like.

In preparing the aqueous dispersions of the invention the components may be simply mixed into the aqueous medium optionally with small amounts of nonionic surfactants, or lower alcohols. Preferably the insoluble carboxylate is mixed first into molten cationic surfactant, optionally together with other conditioning agents mentioned above, and this mixture dispersed in the aqueous medium.

EXAMPLE 1

A composition was prepared by dispersing of 5.9% by weight of molten ditallow dimethyl ammonium chloride (DTDMAC) and 2% aluminium distearate in water. Fabrics steeped in a dilute aqueous solution of the composition and dried were found to be softer than fabrics treated with a similar composition containing no distearate, and as soft as fabric treated with a composition comprising 8.0% DTDMAC in water.

Substantially the same results are obtained if the aluminium distearate is replaced by aluminium tristearate, monostearate, dipalmitate, trioleate, or dibehenate.

EXAMPLE 2

A composition was prepared consisting of a dispersion of 4% by weight of tallowyl propylene diamine hydrochloride, and 3.5% of calcium distearate in water. Fabrics steeped in a dilute aqueous solution of the composition and dried were found to be as soft as fabrics treated with a similar composition comprising 5.9% DTDMAC and softer than those treated with a composition comprising 8.8% tallowyl propylene diamine hydrochloride.

Substantially the same results are obtained if the calcium distearate is replaced by magnesium distearate, zinc distearate, barium distearate, calcium monostearate, calcium mono- or dibehenate.

EXAMPLE 3 & 4

Compositions were prepared consisting of dispersions in water of, by weight:

3.
4.0% Duoquad (Trade Name)
3.0% calcium distearate 4.
4.0% Duomeen (Trade Name)
4.0% calcium distearate Both had softening effect equivalent to that of 5.9% ditallowyl dimethyl ammonium chloride, than which, at current prices, the composition especially of Example 4 is considered cheaper.

Substantially similar performance is obtained if the 4% DUOMEEN of Example 4 is replaced by 2% cetyl trimethyl ammonium bromide and 2% DTDMAC; by 4% tallowyl propylene diamine methosulphate; by 4% cetyl pyridinium chloride, by 4% VARISOFT (trade name); by 4% ADOGEN 477 (trade name); or by 4% LILAMIN 540E03 (from Lilachim), a hydrogenated tallow alkyl propylene diamine having three ethylene oxide groups.

EXAMPLE 5

A textile treatment composition is prepared by dispersing a melt of the following components in 92 parts (%) by weight of water 1.5% Ditallow dimethyl ammonium chloride
1.5% Cetyl trimethyl ammonium chloride
1.5% Glycerine monostearate
1.5% Silicone (viscosity 4000 c.s. at 25° C.)
2.0% Calcium distearate.

In this composition the glycerine monostearate may be replaced by sorbitan monostearate, ethylene glycol monostearate, diglycerol monotallowate, xylitol monopalmitate, or a 1:2 molar mixture of glycerine tristearate and monostearate.

EXAMPLE 6

A textile treatment composition was prepared by mixing a melt of 9 part VARISOFT 455 (Imidazolinium textile softener marketed by Ashland Chemical Co.) and 1 part aluminium distearate in 90 parts of water.

The composition is an effective textile softener when employed as a dilute aqueous solution.

What is claimed is:

1. A textile-treating composition in the form of an aqueous dispersion consisting essentially of (a) from 0.1% to 15% of a fabric-substantive cationic surfactant and (b) from 0.1% to 10% of a substantially water-insoluble di-carboxylate salt based on a carboxylic acid having from 16 to 24 carbon atoms.

2. A composition according to claim 1 wherein said di-carboxylate salt is calcium distearate or aluminium distearate.

3. A composition according to claim 1 wherein the weight ratio of cationic surfactant to insoluble salt is from 3:2 to 2:3.

4. A textile-treating composition consisting of (a) from 2% to 10% by weight of the composition of a cationic surfactant selected from the group consisting of (i) non-cyclic quaternary ammonium salts having two $C_{12}$–$C_{30}$ alkyl chains;

(ii) substituted polyamine salts of formula

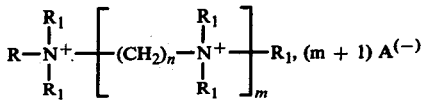

(I)

wherein R is substituted or unsubstituted alkyl or alkenyl group having 10 to 22 carbon atoms; each $R_1$ is independently selected from hydrogen, $C_1$–$C_3$ alkyl, and $(C_2H_4O)_pH$ or $(C_3H_6O)_p$ H, where p is from 1 to 3; m is from 0 to 6; n is from 2 to 6; and $A^{(-)}$ represents an anion;

(iii) $C_8$–$C_{25}$ alkyl imidazolinium salts;

(iv) $C_{12}$–$C_{20}$ pyridinium salts; and (v) a mixture of any two or more of these, (b) from 1% to 6% of a substantially water-insoluble di-carboxylate salt based on a carboxylic acid having from 16 to 24 carbon atoms; and (c) from 84% to 97% of a liquid carrier selected from water, $C_1$–$C_4$ alkanols and mixtures thereof.

5. A composition according to claim 4 wherein the weight ratio of said cationic surfactant to said insoluble salt is from 3:2 to 2:3.

6. A composition according to claim 5 wherein said di-carboxylate salt is calcium distearate or aluminium distearate.

7. A composition according to claim 4 wherein the cationic compound has the formula (I) wherein R is a $C_{12}$–$C_{20}$ alkyl group, m is 1, and each $R_1$ is selected from hydrogen, a $C_1$–$C_3$ alkyl group, and an ethoxy group containing 1 or 2 ethylene oxide units.

8. A composition according to claim 7 wherein the cationic compound is a non-quaternized diammonium salt.

9. A composition according to claim 7 which additionally includes a non-cyclic quaternary ammonium salt having two $C_{12}$–$C_{30}$ alkyl chains and two $C_1$–$C_4$ alkyl groups.

* * * * *